United States Patent [19]

Fang

[11] Patent Number: 4,722,630

[45] Date of Patent: Feb. 2, 1988

[54] CERAMIC-METAL BRAZE JOINT

[75] Inventor: Ho T. Fang, Monterey Park, Calif.

[73] Assignee: The Garrett Corporation, Los Angeles, Calif.

[21] Appl. No.: 778,479

[22] Filed: Sep. 20, 1985

[51] Int. Cl.[4] ..... F16B 9/00; F01D 5/28

[52] U.S. Cl. ..... 403/30; 403/272; 403/404; 416/241 B; 416/244 A; 228/165

[58] Field of Search ..... 416/241 B, 213, 179, 416/244 A; 228/165, 168, 245, 247, 138, 258; 403/404, 273, 272, 41, 30, 305, 29, 28

[56] References Cited

U.S. PATENT DOCUMENTS

| | | | |
|---|---|---|---|
| 1,911,775 | 5/1933 | Smith et al. . | |
| 2,244,109 | 6/1941 | Klein | 403/404 X |
| 2,297,508 | 9/1942 | Schutte . | |
| 2,433,589 | 12/1947 | Adams . | |
| 3,055,100 | 9/1962 | Kimpel . | |
| 3,666,302 | 5/1972 | Kellett | 416/213 |
| 3,667,109 | 6/1972 | Alcenius | 228/245 X |
| 3,801,226 | 4/1974 | Bevan et al. . | |
| 3,865,497 | 2/1975 | Bratt et al. . | |
| 3,905,723 | 11/1975 | Torti, Jr. . | |
| 3,937,103 | 2/1976 | Kleinhans . | |
| 3,999,376 | 12/1976 | Jeryan et al. . | |
| 4,063,850 | 12/1977 | Hueber et al. . | |
| 4,125,344 | 11/1978 | Tiefenbacher . | |
| 4,152,816 | 5/1979 | Ewing et al. . | |
| 4,176,519 | 12/1979 | Kronogard . | |
| 4,235,484 | 11/1980 | Owen et al. . | |
| 4,272,954 | 6/1981 | Kronogard | 416/241 B X |
| 4,279,576 | 7/1981 | Okano et al. . | |
| 4,293,619 | 10/1981 | Landingham et al. . | |
| 4,335,998 | 6/1982 | Siebels . | |
| 4,370,106 | 1/1983 | Lauterbach . | |
| 4,486,147 | 12/1984 | Byrne et al. | 416/241 B |
| 4,614,453 | 9/1986 | Tsuno et al. | 403/273 X |
| 4,639,194 | 1/1987 | Bell et al. . | |
| 4,659,245 | 4/1987 | Hirao et al. . | |

FOREIGN PATENT DOCUMENTS

| | | |
|---|---|---|
| 2422289 | 1/1975 | Fed. Rep. of Germany . |
| 2728823 | 1/1979 | Fed. Rep. of Germany . |
| 2734747 | 2/1979 | Fed. Rep. of Germany . |
| 57-93606 | 6/1982 | Japan . |
| 60-19915 | 2/1985 | Japan . |
| 61-101601 | 5/1986 | Japan . |

*Primary Examiner*—Randolph A. Reese
*Assistant Examiner*—Peter M. Cuomo
*Attorney, Agent, or Firm*—J. Henry Muetterties; R. Steven Linne; James W. McFarland

[57] ABSTRACT

A rotor-shaft assembly which includes a ceramic, solid hubbed turbine rotor having an integral stub shaft brazed within one end of a generally cylindrically shaped sleeve member. A metal shaft is either brazed or cold press fitted within the other end of the sleeve member in a torque transmitting relationship. The stub shaft is formed with an annular relief therearound in order to reduce the compressive forces acting on the stub shaft by the sleeve member.

16 Claims, 7 Drawing Figures

CERAMIC-METAL BRAZE JOINT

BACKGROUND AND SUMMARY OF THE INVENTION

The present invention relates to rotor-shaft assemblies of the type used in exhaust gas driven turbochargers, and more particularly to the attachment of ceramic rotor to a metal shaft assembly.

One means of improving the response time of a turbocharger is to reduce the moment of inertia of the rotating parts by constructing the parts of lighter material, yet the material chosen must be able to withstand the harsh operating environment of the turbocharger. Since the compressor impeller does not see high temperatures in comparison to the turbine wheel, designers began to construct the compressor impellers of low weight aluminum alloy which can survive in the turbocharger environment.

In order to further reduce the weight and therefore the moment of inertia of the rotor-shaft assembly, the industry focused on ceramics as a substitute to the relatively heavy steel turbine wheel. Ceramic substitutes are able to survive the high temperatures and gaseous environment of the turbine. Once the decision has been made to use a ceramic turbine wheel, the focus of attention became the joint between the metal shaft and the ceramic turbine wheel as evidenced by U.S. Pat. Nos. 4,063,850; 4,125,344; and 4,424,003 and German Pat. No. 2,734,797. However, none of these efforts have resulted in a reliable joint as evidenced by the fact that there is no commercially available or production model ceramic turbine wheel on the market, whether it be in turbochargers or any other high speed rotating equipment. Several of these structures teach to shrink fit the ceramic stub shaft of the turbine wheel within a metallic sleeve while others have concentrated on the use of adhesive in order to bond the two materials together.

Utilization of the shrink fit method of attachment gives rise to a further problem: the need to reduce the imposition of the high tensile stresses upon the ceramic stub shaft by the sudden discontinuity of contact between the sleeve member and ceramic rotor. The problem leads to the design feature of scheduling the compressive forces exerted by the sleeve onto the ceramic rotor by substantially tapering the thickness of the sleeve. This reduction in the thickness of the sleeve results in a reduction in the compressive stresses acting on the rotor and the tensile stresses imposed on the ceramic rotor at the point where the contact between the sleeve and rotor ends. It has been found that the tensile and shear stresses which cause the propagation cracks in the ceramic rotor can eventually lead to joint failure.

Furthermore, the high temperature, thermal cycling atmosphere of the turbocharger leads to the degradation and failure of the ceramic rotor-metal shaft joint. Failures occur because of several reasons; the metal sleeve radially expands by a greater degree than the ceramic rotor due to the differential between the two material's coefficient of thermal expansion, thereby loosening the joint (thermal cycling causes "ratcheting", the easing out of the ceramic stub shaft from the sleeve during each cycle) and in the case of adhesives, the breakdown of the adhesive in the high temperature environment.

According to the present invention, a ceramic rotor is attached to a metal shaft via a metal sleeve to form a rotorshaft assembly. The rotor-shaft assembly includes a metal sleeve member having a generally coaxial bore formed therethrough. One end of the sleeve extends generally radially outward to form a hub portion which defines an annular surface area generally coaxial to the shaft. The sleeve hub portion includes an annular groove which is sized to mate with a piston ring located within the center housing near the turbine end of the turbocharger. The ceramic rotor includes a hub and plurality of blades spaced about the circumference of the hub. The rotor further includes a stub shaft integral with and generally symmetrical about the axis of the hub. The stub shaft includes an annular relief therearound. The stub shaft is fitted within the end of the sleeve which defines the sleeve hub portion and the metal shaft is inserted into the other end of the sleeve. Between the ceramic stub shaft and the metal shaft is placed a predetermined amount of braze material. The assembly is heated, thereby melting the braze material which flows into any space between the sleeve and the ceramic stub shaft and metal shaft. Upon cooling, the braze material solidifies and joins the rotor to the shaft.

It is an object of the present invention to provide a ceramic to metal joint for use within a turbocharger.

It is another object of this invention to provide a means from preventing lubricant from entering the turbine housing in the event of a joint failure or ceramic rotor failure.

It is another object of this invention to provide a method of attaching a ceramic shaft to a metal sleeve employing a fluxless brazing operation.

It is a further object to provide a low cost method of joining a ceramic rotor to a metal shaft.

DETAILED DESCRIPTION OF THE INVENTION

Figure 1:
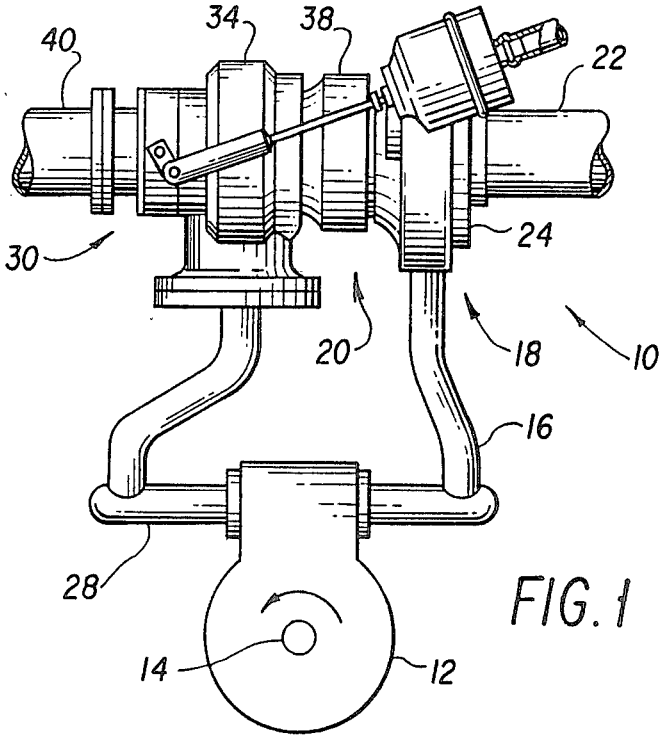
FIG. 1 is an illustration of a turbocharger of the type employing the present invention shown operably coupled to an internal combustion engine.
Figure 2:
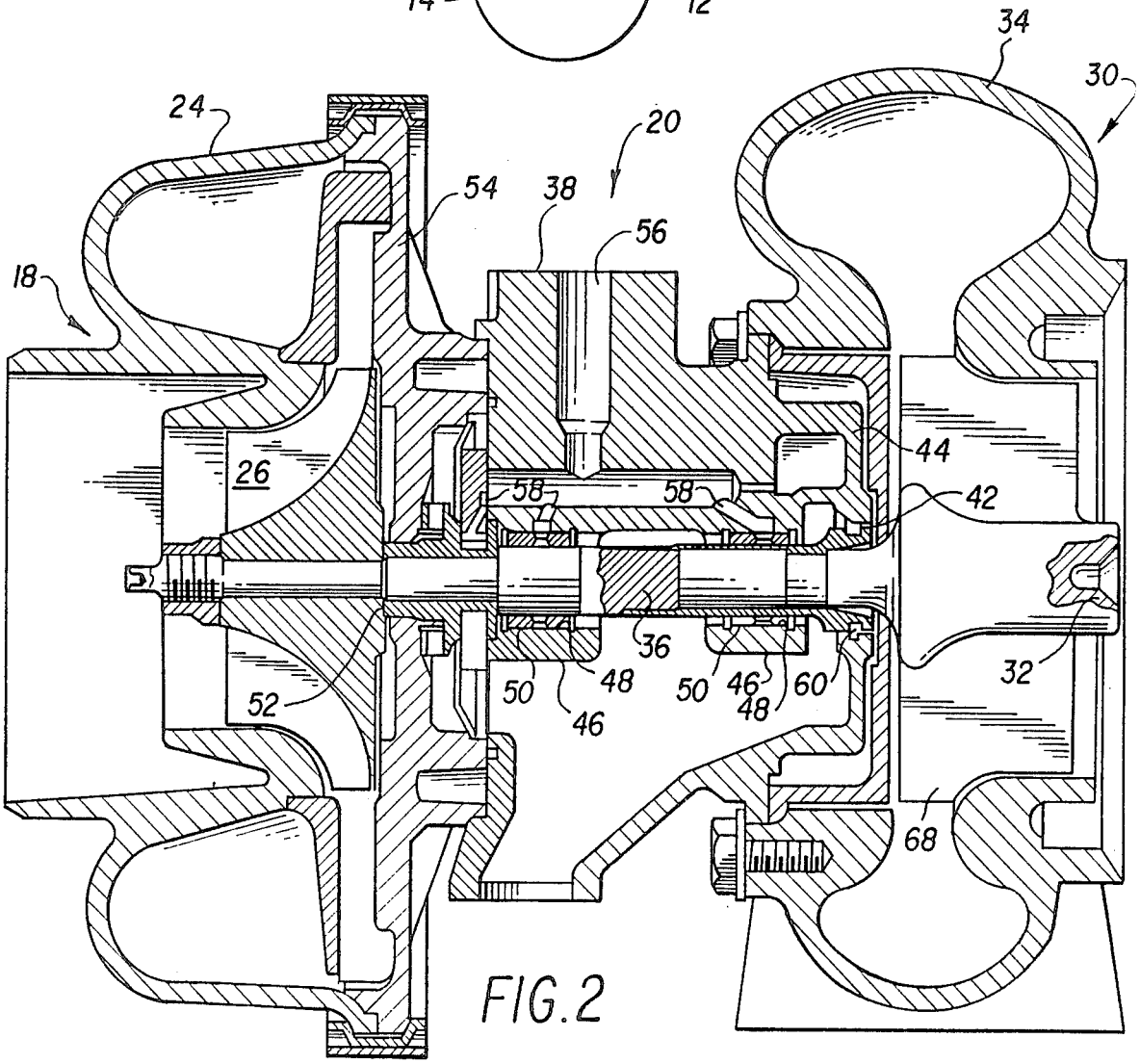
FIG. 2 is a cross-sectional view of a turbocharger of the type employing the preferred embodiment of the present invention.

A turbocharged engine system 10 is shown in FIGS. 1 and 2, and generally comprises a combustion engine 12, such as a gasoline or diesel powered internal combustion engine having a plurality of combustion cylinders (not shown), for rotatably driving an engine crankshaft 14. The engine includes an air intake conduit or manifold 16 through which air is supplied by means of a compressor 18 of the turbocharger 20. In operation the compressor 18 draws in ambient air through an air inlet 22 into a compressor housing 24 and compresses the air with a rotatable compressor impeller 26 to form so-called charge air for supply to the engine for combustion purposes.

Exhaust products are discharged from the engine through an exhaust conduit or manifold 28 for supply to a turbine 30 of the turbocharger 20. The high temperature (up to 1000° C.) exhaust gas rotatably drives a turbine wheel 32 within the turbine housing 34 at a relatively high rotational speed (up to 190K RPM) to correspondingly drive the compressor impeller 26 within the compressor housing 24. In this regard, the turbine wheel and compressor impeller are carried for simultaneous rotation on a common shaft 36 supported within a center housing 38. After driving communication with the turbine wheel 32, the exhaust gases are discharged from the turbocharger 20 to an exhaust outlet 40 which may conveniently include pollution or noise abatement equipment as desired.

The turbocharger, as is shown in FIG. 2, comprises the compressor impeller 26 rotatably connected to shaft 36 within the compressor housing 24. The shaft 36 extends from the impeller 26 thorugh a center housing 38 and an opening 42 formed through the center housing wall 44 for connection to the turbine wheel 32 carried within the turbine housing 34. A compressor back plate 54 separates the center housing 38 and the impeller 26.

The center housing 38 includes a pair of bearing bosses 46 which are axially spaced from one another. The bearing bosses 46 form bearing bores 48 for reception of suitable journal bearings 50 for rotatably receiving and supporting the shaft 36. A thrust bearing assembly 52 is also carried about the shaft for preventing axial excursions of the shaft.

Lubricant such as engine oil or the like is supplied via the center housing 38 to the journal bearings 50 and to the thrust bearing assembly 52. A lubricant inlet portion 56 is formed in the center housing 38 and is adapted for connection to a suitable source of lubricant such as filtered engine oil. The port 56 communicates with a network of internal supply passages 58 which are suitably formed in the center housing 38 to direct the lubricant to the appropriate bearings. The lubricant circulated to the bearings is collected in a suitable sump or drain for passage to appropriate filtering, cooling and recirculation equipment, all in a known manner. To provide against leakage of the lubricant from the center housing into the turbine housing a seal or piston ring 60 is received within an annular groove in the surface of the side wall which defines the shaft opening 42.

DESCRIPTION OF THE PREFERRED EMBODIMENT

Figure 3:
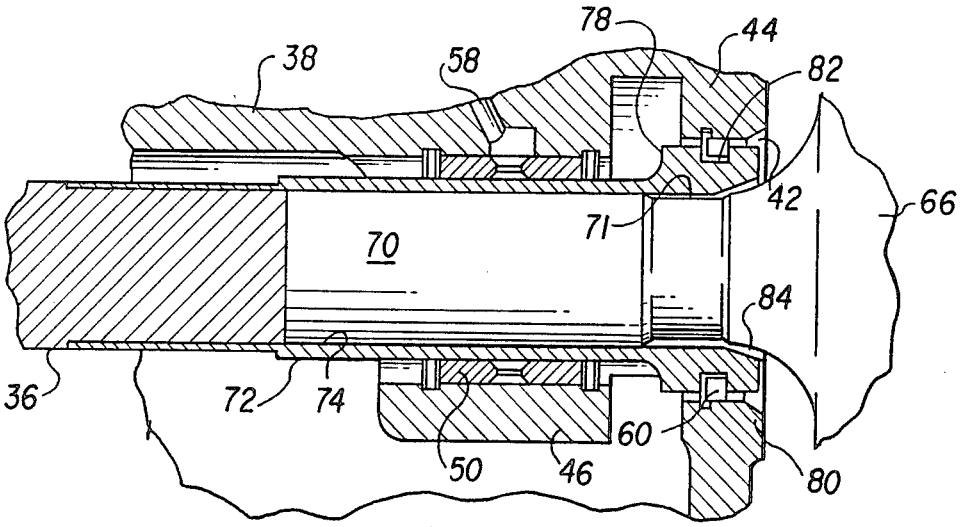
FIG. 3 is an enlarged, partial cross-sectional view of a portion of the turbocharger of FIG. 2.
Figure 4A:
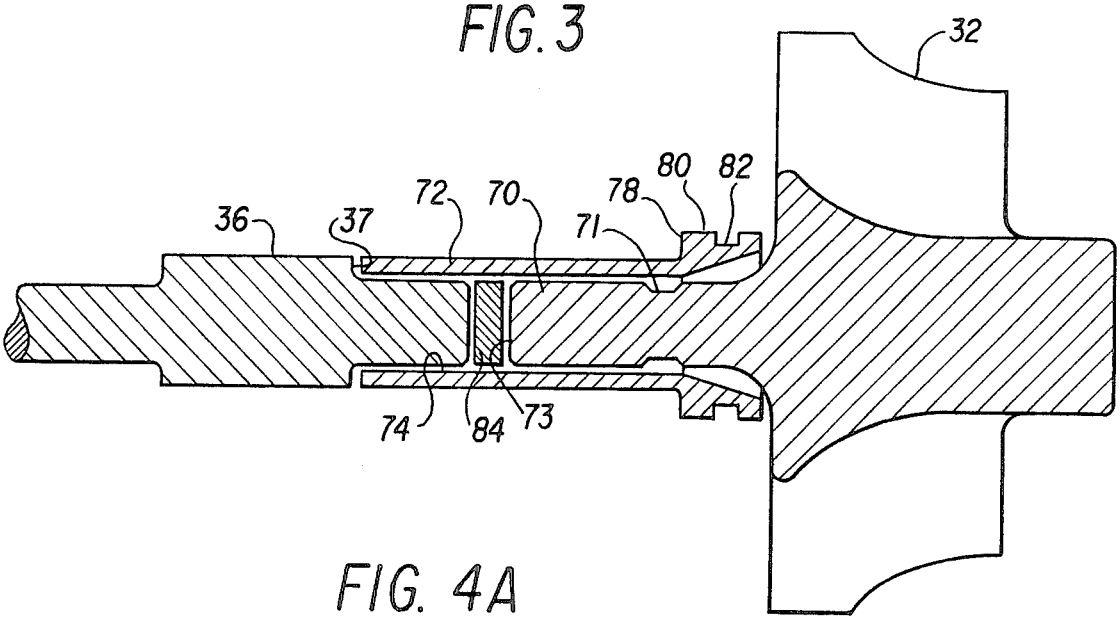
FIGS. 4A and 4B are cross-sectional views of the preferred ceramic rotor-metal shaft assembly as shown in FIGS. 2 and 3, with the areas to be filled with the braze alloy shown in exaggerated size to provide detail.
Figure 4B:
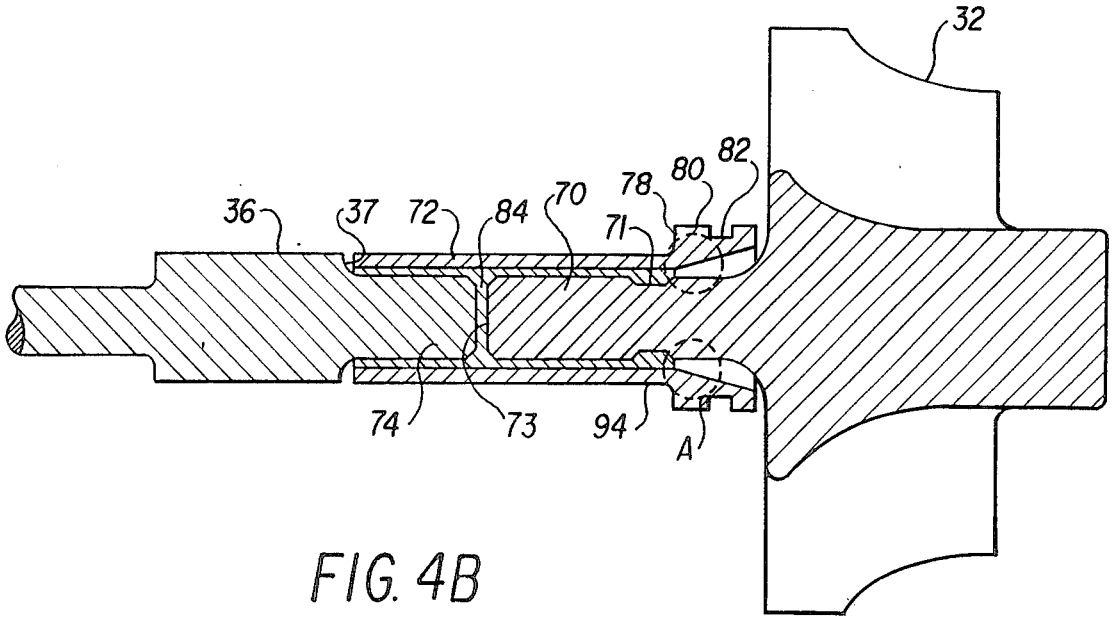

The rotor-shaft assembly of the present invention is shown in FIGS. 2, 3 and 4 in its preferred form. The assembly includes a ceramic rotor, a metal sleeve member and a metal shaft. The ceramic rotor or ceramic turbine wheel 32 includes a hub 66 and a plurality of blades 68 periodically spaced about the circumference of the hub 66. The rotor 32 further includes a stub shaft 70 integral with and generally symmetrical about the axis of the hub 66. The stub shaft 70 includes an annular relief or undercut 71. The relief 71 is approximately 0.0015–0.0030" in depth.

The metal sleeve member 72 is generally cylindrically shaped and includes a coaxial bore 74 therethrough which may be cast, machined or otherwise formed therein. As shown the bore 74 has a constant diameter in that area which is in contact with the ceramic stub shaft, but a slight taper extending radially outward toward the other end (the outboard end referring to the end away from the middle of the object) can also be used.

At the outboard end of the sleeve member 72 is a generally radially outwardly extending hub portion 78 which defines an annular surface area 80 coaxial to the sleeve member 72. The annular surface 80 includes an annular piston ring groove 82 therein which is sized to operably mate with the piston ring 60 located within the center housing 38 of turbocharger 20. The incorporation of the hub section 78 and the piston ring groove 82 ensures that if failure of the ceramic rotor occurs the seal between the center housing 38 and the turbine housing 34 remains intact. Additionally, seal 60 provides the normal function of sealing during separation.

The joint is assembled by melting and solidifying a braze alloy 84 inside the joint. A predetermined amount of braze alloy 84 is placed between the ceramic stub shaft 70 and the end of metal shaft 36, as seen in FIG. 4*a*. When the joint area is heated up to the melting temperature the braze alloy 84 fills the gaps between the sleeve member 72 and the ceramic stub shaft 70. At brazing temperature, the gap between the sleeve member 72 and the stub shaft 70 has expanded due to the higher thermal expansion coefficient of the sleeve member 72 compared to the ceramic. Upon cooling, the braze alloy solidifies and the sleeve member 72 tries to shrink back to the original shape at room temperature. The contraction of the sleeve member 72 exerts a radial compressive force on the cermaic stub shaft 70 through the braze layer and joins the sleeve 72 to the ceramic stub shaft 70 and the shaft 36.

Relief 71 performs an important function; it acts to prevent the braze alloy from making its way into the area generally designated as A in FIG. 4. During the brazing operation, the melted braze alloy fills the gap between the ceramic stub shaft and the sleeve member due to capillary action. When the braze alloy enters the reservoir area created by relief, the capillary action is interrupted. Hence the braze alloy does not flow into area A, which ensures that the point at which the sleeve member exerts a compressive force on the ceramic stub shaft via the braze material is located within the area defined by the relief. This is important because it has been found that the compressive forces are greater in those areas where the metal sleeve is radially thicker and the gaps are narrowest, i.e. between the end of the stub shaft and relief 71 and in area A. While the discontinuity will be sudden, the compressive forces acting on the ceramic stub shaft in the relief area will not be as high as they would be if discontinuity occurred in area A. Since the spacing between the stub shaft and the sleeve member is increased by the relief, the compressive forces fall because of the amount and relative "softness" of the braze alloy in comparison to the Incoloy sleeve member, Hence, there is a scheduling of the compressive forces from its maximum to a minimum, which occurs in the area of relief 71.

As shown in FIG. 3, the assembled rotor-shaft assembly has been machined in order to prepare the outer diameter of the sleeve member and the shaft for close tolerance rotation within bearings 50.

By way of example, a sleeve member made of Incology 903 was machined as shown in FIG. 4 having a constant bore diameter of 0.3160±0.0005. The ceramic turbine wheel was formed with a stub shaft having a diameter of 0.31325±0.00025 inches. A predetermined amount of a braze alloy 84 was placed within the joint as shown in FIG. *4a*. Several braze alloys which have been successfully tested are Braze Nos. 45, 505, 716 and 720 available from Handy & Harman and "Ticusil" and "Cusil" available from GTE-WESGO. These braze alloys have melting temperatures ranging from 1150° to 1600° F. The type of braze alloy used depends on the ultimate temperature to which the assembly will be exposed. The joint was heated using an induction coil, raising the temperature of the braze material to above its melting temperature, at which point the braze alloy flows into the gaps between the sleeve member and both the stub shaft and the shaft. Upon cooling the joint between the three pieces was formed as shown in FIG. *4b*.

Figure 5:
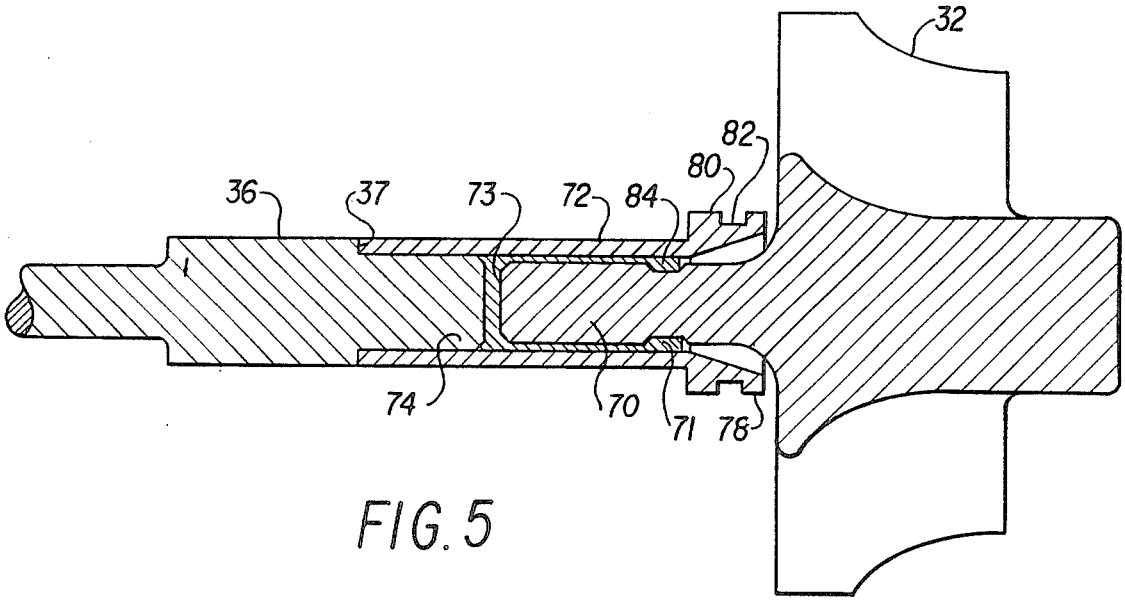
FIG. 5 is a cross-sectional view of an alternative ceramic rotor-metal shaft assembly, with the areas to be filled with the braze alloy shown in exaggerated size to provide detail.

An alternative rotor-shaft assembly is shown in FIG. 5. The assembly of FIG. 5 shows the turbocharger shaft 36 which has been cold press interference fitted within the inboard end of the sleeve member 72 before the brazing of the sleeve member 72 to the ceramic stub shaft 70 as described above. This alternative arrangement reduces the amount of braze alloy needed and the length of heating time. In order to accomplish cold pressing of the metal shaft within the sleeve, the shaft's diameter must be slightly larger than the bore in the sleeve.

A tolerance of ±0.00025 is sufficient for the cold press fitting of the metal turbocharger shaft 36 within the sleeve member 72. Furthermore, this metal to metal joint has good high temperature strength due to the higher thermal expansion coefficient of the 4140 steel used for shaft 36 than the Incology 903 sleeve member.

Figure 6:
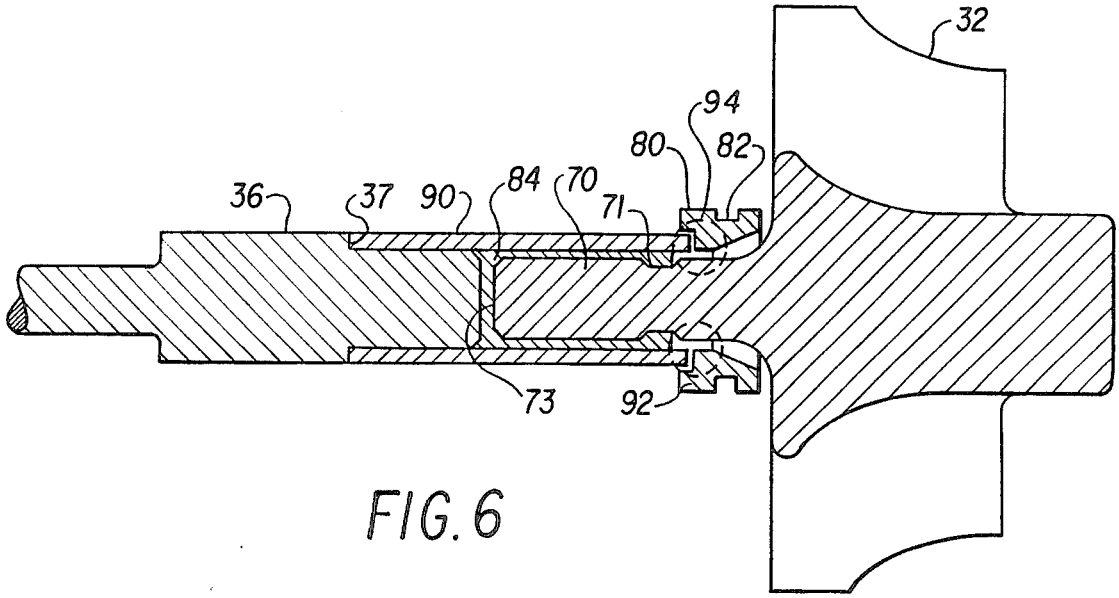
FIG. 6 is a cross-sectional view of another alternative ceramic rotor-metal shaft assembly, with the areas to be filled with the braze alloy shown in exaggerated size to provide detail.

An alternative feature is shown in FIG. 6 and includes a sleeve member 90 which is fabricated from Incology. A hub section 92 is made from a low cost, easy to machine steel (4140 steel). The hub section 92 can either be brazed to the sleeve member 90 during the same brazing operation described above or pre-welded to the sleeve member by electron beam, laser or inertia welding.

In all applications, the sleeve member is located within the bearing 50 nearest the turbine end of the turbocharger. This placement assists in lessening the degree of thermal cycling experienced by the joint and in particular the braze alloy. While this is not of any particular concern when considering the joint between shaft 36 and sleeve member 72, because the compressive forces exerted on the shaft increase during use due to the difference in their respective coefficients of thermal expansion, it does affect the joint between the sleeve member 72 and ceramic stub shaft 70. At room temperature the coefficient of friction between the sleeve and ceramic stub shaft is high and the strength (tensile) of the braze alloy is at its maximum, thereby creating a reliable joint. Any temperature increase causes the metal sleeve to expand away from the ceramic stub shaft and tends to reduce the compressive force that held the joint together. However, the higher temperature also expands the braze alloy and increases the coefficient of friction between the braze metal and the ceramic shaft; the net effect being only a slight drop in joint strength. If exposed too high of operating temperatures, the braze alloy will soften rapidly or melt and the joint will fail. Hence, positioning of the sleeve within an oil cooled bearing is advantageous.

It is also possible to use a braze alloy containing "reactive" metal (eg. titanium) to form some intermetallic compound between the braze alloy and the ceramic and to develop a chemical bond between the two. This additional bonding should increase the high temperature reliability of the joint.

According to the present invention, the rotor-shaft assembly of the preferred embodiment is constructed by inserting the shaft 36 into the sleeve member 72 so that the shoulder 37 abuts the end of the sleeve member. A predetermined amount of solid braze alloy is placed atop the end of shaft 36 within sleeve member 72. The stub shaft 70 of the rotor 32 is placed within the other end of sleeve member 72. This workpiece is placed within an induction heating apparatus, wherein under an inert atmosphere (argon) the temperature is raised to a temperature above the melting temperature of the braze alloy. The melted braze alloy fills the gaps between the sleeve member and the stub shaft and metal shaft. Capillary action accounting for any flow upward into the gap between the sleeve and stub shaft. Gravitational forces seat the end of the stub shaft against the end of shaft 36 as the braze alloy melts. Thereafter, the assembly is allowed to cool to room temperature.

It is important to note that the following method of joining takes place within an inert atmosphere and without the use of a flux material. It has been found that the flux material coats the ceramic stub shaft during the brazing operation. Once the rotor-shaft is reheated, the flux layer on the ceramic stub shaft melts at a temperature well below the melting temperature of the braze alloy. This drastically reduces the coefficient of friction, allowing the stub shaft to be rotated in or withdrawn from the sleeve member.

Various modifications to the depicted and described apparatus and method will be apparent to those skilled in the art. Accordingly, the foregoing detailed description of the preferred embodiment of the invention should be considered exemplary in nature, and not as limiting to the scope and spirit of the invention as set forth in the appended claims.

Having described the invention with sufficient clarity that those skilled in the art may practice it, I claim:

1. A rotor-shaft assembly comprising the combination of:

a metal sleeve member having an inner surface defining a bore therethrough;

a ceramic rotor having a stub shaft symmetrically distributed about the rotor axis, said stub shaft having an exterior surface with a diameter slightly smaller than the diameter of said bore and including an annular relief along a portion of said exterior surface;

a metal shaft having a diameter slightly smaller than said bore; and a braze alloy disposed between said inner surface of said sleeve member and said exterior surface of said stub shaft and said metal shaft, wherein said braze alloy at least partially fills said relief.

2. The rotor-shaft assembly of claim 1 wherein said sleeve is Incology and said metal shaft is steel.

3. The rotor-shaft assembly of claim 1 wherein said relief is approximately 0.0020 inches in depth.

4. The rotor-shaft assembly of claim 1 wherein said sleeve member includes an outwardly extending hub portion which defines a surface area coaxial to the axis of said sleeve.

5. The rotor-shaft assembly of claim 4 wherein said surface area includes an annular groove therein.

6. A rotor-shaft assembly comprising the combination of:

a sleeve member having an inner surface defining a bore therethrough;

a ceramic rotor having a stub shaft including an annular relief therearound;

a metal shaft; and means for simultaneously joining said ceramic rotor stub shaft and said metal shaft to the inner surface of said sleeve member in a torque transmitting relationship while reducing the forces exerted on said stub shaft by the end of said sleeve member.

7. The rotor-shaft assembly of claim 6 wherein said sleeve member is generally cylindrically shaped and includes a bore coaxially therethrough.

8. The rotor-shaft assembly of claim 7 wherein said ceramic rotor includes a coaxial stub shaft having a diameter slightly smaller than the diameter of said bore.

9. The rotor-shaft assembly of claim 8 wherein said stub shaft and said metal shaft are inserted into opposite ends of said bore.

10. The rotor-shaft assembly of claim 6 wherein said means for simlultaneously joining comprises a braze alloy.

11. A rotor-shaft assembly comprising:

a metal sleeve member including an inner bore therethrough;

a ceramic rotor including a stub shaft having an annular relief thereon;

a metal shaft;

means for rotatably securing said stub shaft and said metal shaft within said inner bore of said sleeve member; and wherein said annular relief acts as a means for reducing the compressive forces exerted on at least a portion of said stub shaft by the end of said metal sleeve member.

12. The rotor-shaft assembly according to claim 11 wherein said means for rotatably securing is a braze alloy.

13. The rotor-shaft assembly according to claim 11 wherein said means for rotatably securing is a braze alloy between said rotor and sleeve member and a cold press interference fit between said shaft and sleeve member.

14. An improved rotor shaft assembly of the type used in exhaust gas driven turbochargers to connect a ceramic turbine rotor to a metal compressor impeller, said assembly comprising the combination of:

a stub shaft integral with and extending from the ceramic rotor along its rotational axis, said stub shaft having a generally cylindrical exterior surface parallel to said rotational axis and spaced therefrom by a generally constant first diameter along a major portion of its length, said exterior surface further including an annular relief area over a minor portion of its length, said relief having a second diameter less than said constant first diameter;

a metal shaft adapted to connect the metal compressor impeller at one end to the ceramic turbine rotor at the other end, said other end of said shaft being generally cylindrical and having a substantially constant diameter;

a metallic sleeve member having a generally cylindrical inner surface defining a bore therethrough, said bore having a diameter greater than said constant first diameter of the exterior surface of said stub shaft, said sleeve member positioned to surround and contain within its bore the end of said ceramic stub shaft and the other end of said metal shaft; and a metallic braze alloy bonded to the inner surface of said sleeve member and said ceramic stub shaft, said braze alloy filling the space between the sleeve and said major portion of the stub shaft up to but not beyond said relief area.

15. The rotor shaft assembly of claim 14 wherein said second diameter of said relief area is between about 0.0015 to 0.0030 inch less than said constant first diameter of said stub shaft and said relief area is only partially filled with said braze alloy thereby reducing the concentration of stresses exerted on said ceramic stub shaft by the adjacent end of said sleeve member.

16. The rotor shaft assembly of claim 14 wherein said braze alloy contains a reactive metal which forms intermetallic compounds between the braze alloy and the ceramic so as to develop a chemical bond therebetween.

* * * * *